US006996886B1

(12) United States Patent
Rinner

(10) Patent No.: US 6,996,886 B1
(45) Date of Patent: Feb. 14, 2006

(54) METHOD OF MAKING A TORQUE TOOL HANDLE

(75) Inventor: James A. Rinner, Racine, WI (US)

(73) Assignee: Pilling Weck Incorporated, Horsham, PA (US)

( * ) Notice: Subject to any disclaimer, the term of this patent is extended or adjusted under 35 U.S.C. 154(b) by 0 days.

(21) Appl. No.: 10/923,766

(22) Filed: Aug. 23, 2004

Related U.S. Application Data

(62) Division of application No. 10/215,405, filed on Aug. 9, 2002, now Pat. No. 6,807,883.

(51) Int. Cl.
*B25B 23/16* (2006.01)

(52) U.S. Cl. ..... 29/434; 29/242; 29/243; 81/177.5; 81/489

(58) Field of Classification Search ..... 29/434, 29/520, 525, 242, 243, 270, 278; 81/177.1, 81/177.5, 177.85, 438, 489
See application file for complete search history.

(56) References Cited

U.S. PATENT DOCUMENTS

| | | | | |
|---|---|---|---|---|
| 2,774,133 | A * | 12/1956 | Stiz | 29/254 |
| 2,836,091 | A * | 5/1958 | Mann | 81/125 |
| 3,672,419 | A | 6/1972 | Fischer | |
| 4,692,073 | A | 9/1987 | Martindell | |
| 6,055,889 | A | 5/2000 | Rinner | |
| 6,199,872 | B1 | 3/2001 | Hasan | |
| 6,352,011 | B1 * | 3/2002 | Fruhm | 81/438 |
| 6,564,680 | B1 | 5/2003 | Rinner et al. | |

FOREIGN PATENT DOCUMENTS

JP 07068477 A * 3/1995

* cited by examiner

*Primary Examiner*—David P. Bryant
*Assistant Examiner*—Jermie E. Cozart
(74) *Attorney, Agent, or Firm*—Arthur J. Hansmann

(57) ABSTRACT

A torque tool handle for releasably holding a driven shank, such as a screwdriver bit. The handle is elongated and has an opening with a sleeve therein carrying a detent and an actuator which is slidable on the sleeve for alternate locking and release of the detent relative to the shank disposed in the sleeve. There can be two handle openings at right angles to each other and with each having a sleeve and an actuator and a detent, so the handle is both an axial and a T-handle driver.

4 Claims, 3 Drawing Sheets

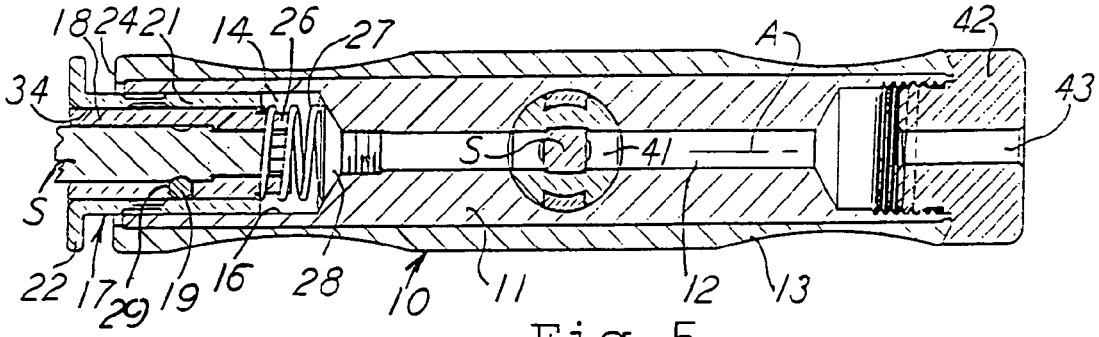
Fig.5
Fig.6
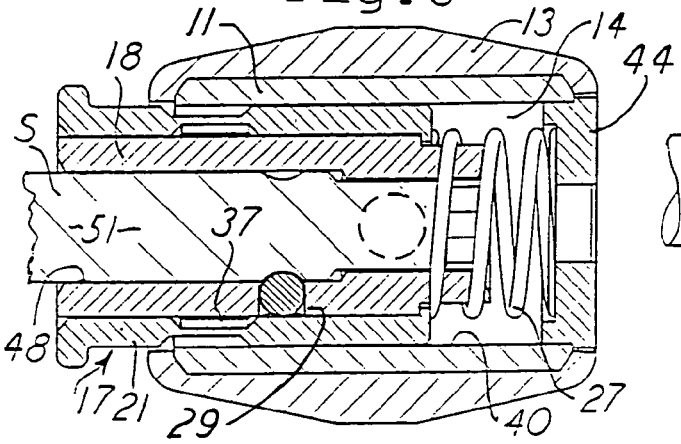
Fig.11
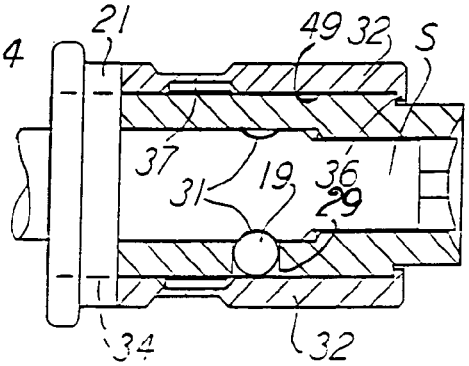
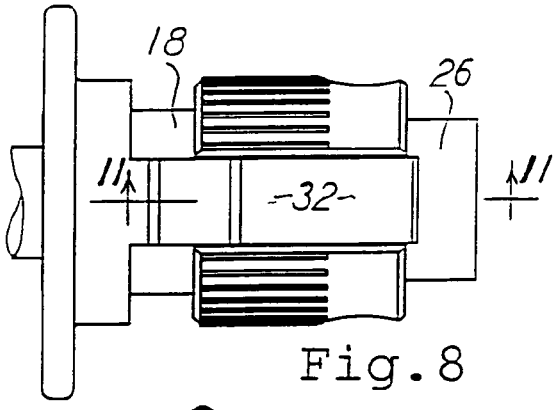
Fig.8
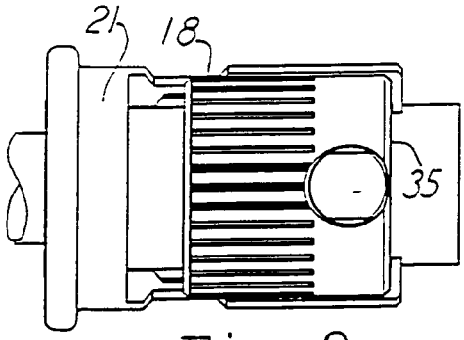
Fig.9
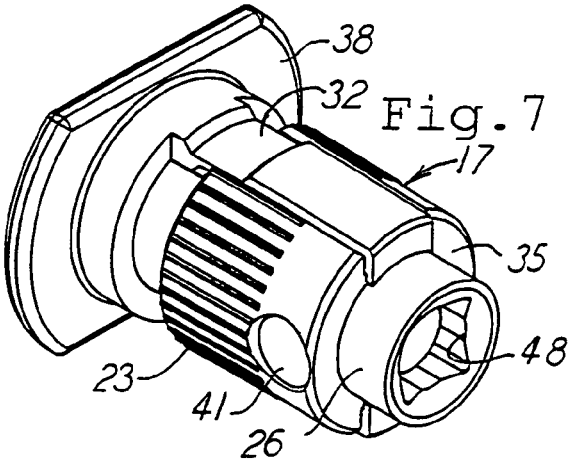
Fig.7
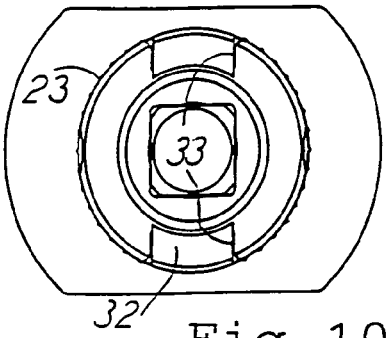
Fig.10

Fig.13
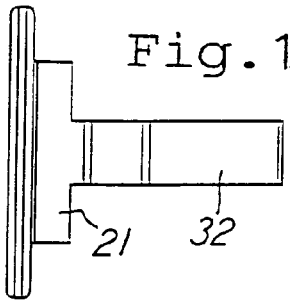
Fig.22
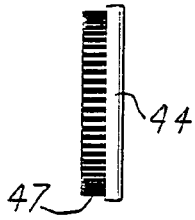
Fig.23
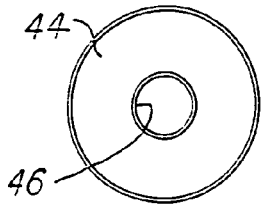
Fig.12
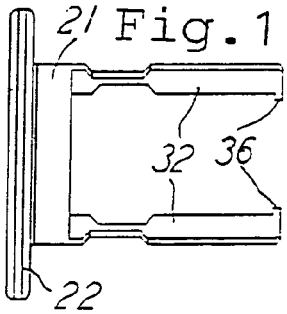
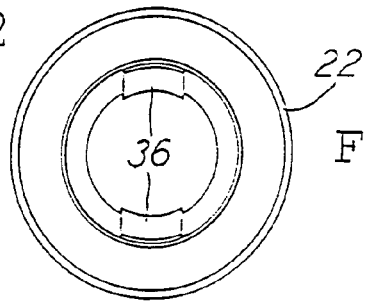
Fig.14
Fig.24
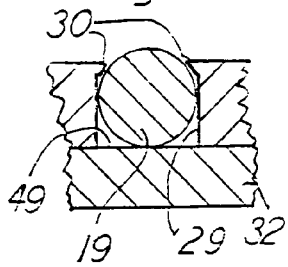
Fig.15
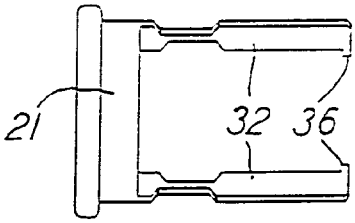
Fig.16
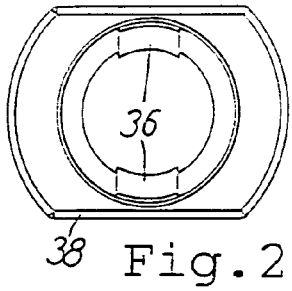
Fig.18
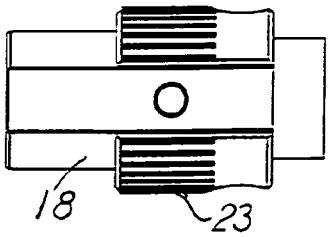
Fig.20
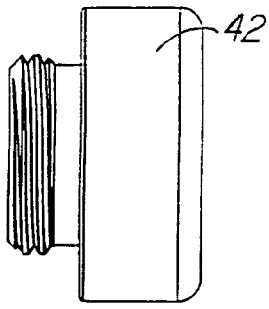
Fig.21
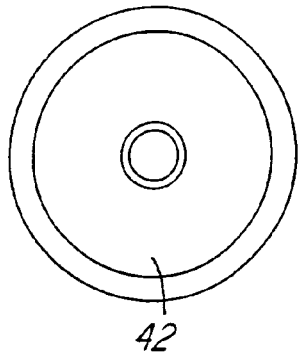
Fig.17
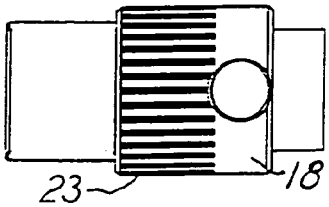
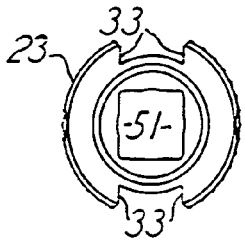
Fig.19

METHOD OF MAKING A TORQUE TOOL HANDLE

This application is a divisional of U.S. application Ser. No. 10/215,405, filed Aug. 9, 2002, now U.S. Pat. No. 6,807,883.

This invention relates to a hand-manipulated torque transmitting tool, and, more particularly, it relates to that type of tool with a removable and replaceable tool bit or shank, such as a screwdriver shank.

BACKGROUND OF THE INVENTION

This particular invention pertains to a tool shank that is replaceably held in the handle portion of the torque tool and is held therein by means of a ball and groove interconnection between the handle itself and the shank of the tool bit. In the present instance, the ball and groove connection is arranged to be most secure and reliable, and it is significant that the entire tool is of a non-complicated and easily manufacturable and reliable construction. Also, the tool can be readily cleaned.

In addition to the aforementioned, the handle body is arranged to control the position of the securing ball and to do so by an arrangement of an actuator member movable relative to the handle body and being controlled by the operator for positioning the ball in either the bit holding position or the bit released position. The bit holding position is automatically achieved.

Still further, the handle is arranged for reception of the releasable bit in two different and right angle related positions on the handle itself, and thus the operator can apply respective hand force on the handle to accommodate the location of the bit in either of the two positions mentioned. That is, the handle can be arranged for axial drive and for T-handle torque application. In both arrangements, the same driven bit or the like can be selectively accommodated in the axial and the T-handle positions. The release of the bit and its connections to the handle, in either drive position, are both readily and easily accomplished.

In the specific arrangement constituting this invention, there is no requirement for a spring-urged ball to hold a replaceable tool bit to a handle, and thus the inherent degree of failure of that type of spring-urged ball connection is avoided in the present invention. That is, the present invention does not rely upon any spring-urged ball which, by virtue of the spring resilience, is subject to inadvertent release of the tool bit from the handle body itself.

Also, the handle accommodates cannulation through the handle in both of the aforementioned directions of handle use.

The method of making the tool is also a part of this invention.

BRIEF DESCRIPTION OF THE DRAWINGS

FIG. 5 is a section view taken on the plane designated by the line 5—5 on FIG. 2.

FIG. 6 is an enlarged section view taken on the plane designated by the line 6—6.

FIG. 7 is an enlarged perspective view of a portion of the tool shown in FIG. 6.

FIGS. 8, 9, and 10 respectively are top, front, and right end orthographic views of that shown in FIG. 7.

FIG. 11 is a section view taken on the plane designated by the line 11—11 on FIG. 8.

FIGS. 12, 13, and 14 respectively are front, top, and right end enlarged orthographic views of a piece shown on the left end of FIG. 2.

FIGS. 15 and 16 respectively are front and right end reduced orthographic views of a piece shown in FIG. 7.

FIGS. 17, 18, and 19 respectively are front, top, and right end reduced orthographic views of a piece shown in FIG. 7.

FIGS. 20 and 21 respectively are front and right end enlarged orthographic views of a right end piece shown in FIG. 1.

FIGS. 22 and 23 respectively are right end and back views of a piece shown in the top center of FIG. 2 and in FIG. 6.

FIG. 24 is an enlarged section view of a portion of FIG. 6.

DETAILED DESCRIPTION OF THE INVENTION

Figure 2:
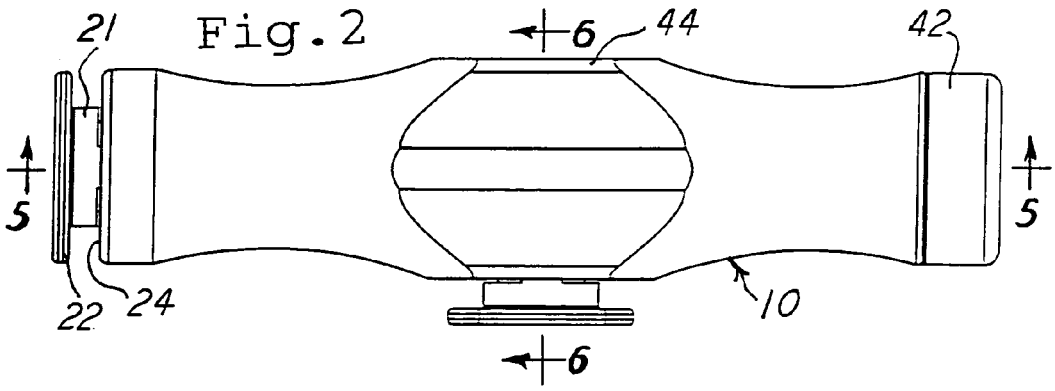
FIG. 2 is a top plan view of FIG. 1.

FIGS. 1–5, show an embodiment of the invention with a handle generally designated 10 and including a cylindrically shaped body portion 11 having an opening 12 extending longitudinally axially therethrough. The body 11 can be made of aluminum, and soft metal is preferred, and it also can have a surrounding cover 13 of rubber or elastomer material molded to the exterior of the then body core 11. Accordingly, it will be seen and understood that the handle 10 is suitable for gripping and torquing about the longitudinal axis A along the central opening 12, as seen in FIG. 5, and it is also shaped and suitable for gripping or turning about an axis B seen in FIG. 3 and which is perpendicular to the longitudinal axis A. Where the driven shank is aligned with the axis B, the handle serves as a T-handle.

In both instances, it will be seen and understood that working tools, such as screwdriver bits S in FIGS. 5, 6, and 10, can be placed to extend along either the longitudinal axis A or the transverse axis B. Also, in place of a screwdriver bit S and its shown shank, an unshown adapter shank, or any other shank could be received in the handle's shown two openings. Thus the tool 10 selectively serves as an axial or a T-handle driver. Also, the molded cover 13 has ergonomically compatible shapes, such as those shown.

The present invention provides for quick and secure assembly of the bits S with the handle 10, in both the axial and the T-handle arrangements. The bit can be snapped into and out of the handle 10. Also, the tool is particularly useful in medical procedures, and cannulation is a feature because a probe can be inserted through the handle 10 at the through openings along both axes A and B.

The core 11 has an enlarged cylindrical opening 14 along axis A at the left terminal end of the handle as seen in FIG. 5, and there is a circular wall 16 surrounding and defining the opening 14. There is a sub-assembly 17 disposed in the opening 14, and a tool bit or shank S is also shown in 17. The sub-assembly is co-axial on the axis A, and it extends outside the handle core 11 and handle cover 13. The sub-assembly seen in FIG. 5 includes a cylindrical sleeve 18, a detent ball 19, and an actuator 21 which has an integral circular head 22. FIGS. 12, 13, and 14 show free-body views of the actuator 21.

The sleeve 18 has ribs or knurling at 23, as seen in FIG. 7, and the diametric size at 23 is that of the wall 16 so the sleeve 18 can be press-fitted into the opening 14 and thereby have the sleeve 18 affixed with the core 11 and avoid movement relative to the core 11. The handle 10 has a circular end wall 24, and the sleeve 18 extends outside the limit of the end wall 24, as seen in FIG. 5. The inner end 26 of the sleeve 18 pilots a coil spring 27 which is bottomed on a piece 28 affixed to the core 11 and is in the opening 14. The spring 27 can move axially on the sleeve end 26.

The sleeve 18 has an opening 29 extending radially therethrough for reception of the detent ball 19, as seen in FIGS. 5, 6, 11 and 24. The arrangement with the ball 19 is such that the ball is restrained against movement radially inward of the sleeve so it will not fall into the sleeve interior, and that arrangement can be as shown in FIG. 24 by having a shoulder 30 on the sleeve around the opening 29. However, the ball 19 can move radially outward relative to the sleeve 18. Of course the detent ball 19 will project on the sleeve to engage the circular groove 31 on the bit S. Thus, the bit S can not move axially relative to the sleeve 18 and thus relative to the handle 10 until the ball detent is released.

The actuator 21 controls the ball in that it extends over and into contact with the ball 19, as best seen in FIGS. 5, 6, and 24. The actuator 21 has two tangs or arms 32 in diametrically opposite positions and extending axially from the head 22. The sleeve 18 has two diametrically disposed grooves 33 for snugly but slidably receiving the respective tangs 32. The tangs 32 are snug between the sleeve 18 and the handle wall 16, but the actuator 21 is axially slidable on the sleeve 18. Also, as seen in FIG. 11, the actuator 21 has a central opening 34 for snugly mounting on and piloting on the end of the sleeve 18. The tangs 32 are shaped to conform to the curvature of both the wall 16 and the shape of the sleeve grooves 33. Thereby, the tangs 32 are restrained radially inwardly and onto the ball 19. That is, the sleeve 18 presents a radial space between it and the wall 16, and the actuator 21 occupies that space and is guided therein both radially and in its axial movement.

The axially inner end of the actuator 21 has inturned ends 36 on each tang 32. The amount of the inturn is sufficient to have the ends 32 overlap the end of the sleeve 18 and to abut the end wall 35 of the sleeve and thereby restrict the tangs 32 and the actuator 21 in the axial movement of the actuator leftwardly as viewed in the drawings. So the actuator 21 can move axially rightward, as viewed in the drawings, to compress the spring 27, but it can not move leftward from the shown position relative to the sleeve 18. The spring 27 urges the actuator to its shown leftward seated position, and that is the secure position of the ball 19 engaged with the bit S, as desired, and in an automatic action.

The tangs 32 have relieves 37 thereon, and they align with and thereby receive any nearby ball 19 to release the ball relative to the bit groove 31. Thereby, the bit S is released from the handle 10. To achieve that release, the actuator 21 is slid axially inward along the sleeve 18 and against the spring 27 to a position of reception of the ball 19 by the recess 37. There may be only one ball 19, as shown, or there could be two balls 19 in the event the sleeve 18 is provided with two holes 29 located at the top and bottom of the sleeve 18 as viewed in FIG. 11, for instance. The axial distance between the ball 19 and the relief 37 is less than the axial distance between the head 22 and the end wall 24. Thus, when the actuator 21 is in the locked position with the ball 19, as shown, the actuator 21 is always free to shift to the right to align the relief 27 with the ball 19 and thereby receive the ball 19 in the relief 37 to unlock the ball 19 from the shank S. The positioning of the sub-assembly of the sleeve 18, and the ball 19, and the actuator 21 thus, in the press fit that can be utilized, arranges for that axial distance relationship. Spring 27 can be included.

The diametric extent of the head 22 is that of the outer diameter of the handle at its end 24, and thus the head 22 aligns with the circular end wall 24 of the handle, and does not radially extend therebeyond.

Figure 1:
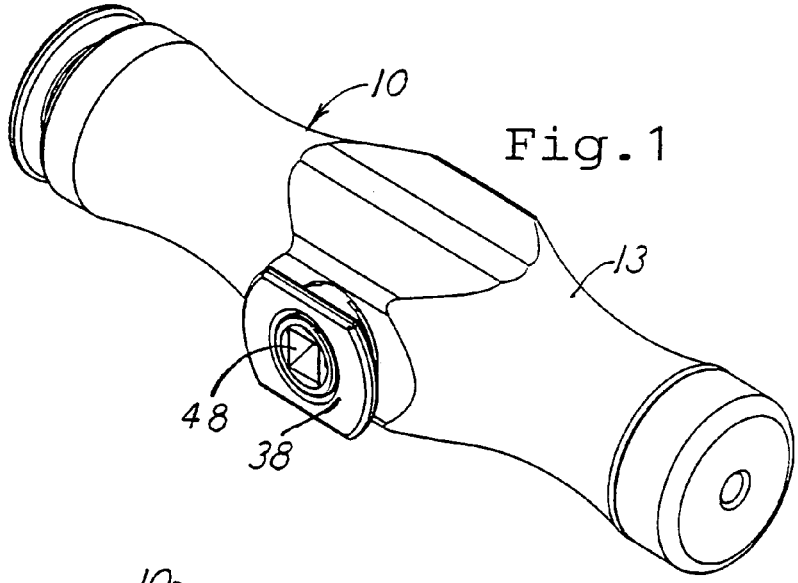
FIG. 1 is a perspective view of one embodiment of the tool of this invention.
Figure 3:
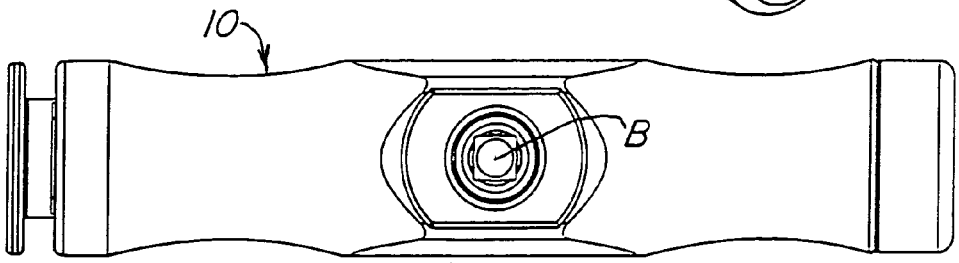
FIG. 3 is a front elevation view of FIG. 1.
Figure 4:
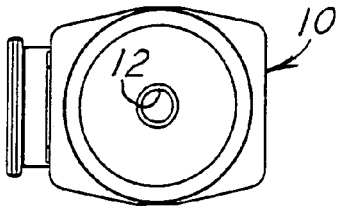
FIG. 4 is a right end elevation view of FIG. 1.

The foregoing describes generally the axial arrangement for the bit S, or any other bit, which extends along the axis A. The arrangement for the axis B, which is the T-handle arrangement, is identical except for the shape of the actuator head 38 which is shown to be truncated to have the shape as best seen in FIGS. 1, 3, 16. With that shape, the head 38 is ergonomically satisfactory. However, the assembly 17, with its sleeve 18, ball 19, and actuator 21, except for the shape of the actuator head, exists in the handle on axis B as it does and as described and shown with axis A, and, as seen in FIG. 6, the two assemblies 21 are modular, and the core 11 has the two circular openings 16 and 40 which are of the same diameter for the respective reception of the assemblies 21. The two assemblies 21 always remain in their assembled positions.

The sleeve 18 has a through passageway 41 extending throughout its diameter, and that is useful in the axis B arrangement. The opening 41 aligns with the longitudinal opening 12 to arrange for cannulation-along axis A and of course when no bit or shank is installed.

A plug 42 is threaded into the handle core 11 at the right end as seen in FIG. 5, and it has a central opening 43 for the cannulation mentioned. Also, there is a plug 44, as seen in FIGS. 2, 6, and 23, on the axis B, and the plug 44 has a central opening 46 for cannulation along axis B. Plug 44 is pressed into the handle core 11 with the knurls 47 on the plug 44.

Each of the two sleeves 18 has an interior drive opening 48 for reception of the bits S in a rotational drive relationship in any suitable manner, such as a square socket drive at the inner ends of the sleeves 18 as seen in FIGS. 6 and 7. Sleeves 18 may be of metal harder than core 11.

In the locked position shown herein, the actuator 21 has a surface 49 which is substantially of the diameter as the outer diameter of the grooves. Thus, the ball 19 is forced into the hole 29 when the actuator 21 is in the FIG. 11 locked-position, as seen in FIGS. 6 and 11. The actuator 21 can move leftwardly from the unlocked position to the shown locked position, and indeed the spring 27 so urges the actuator 21 to the locked position whenever there is no rightward force on the actuator. So there is automatic locking onto the inserted shank.

The foregoing discloses the method of making the tool, namely, forming the core with its axial openings along both axes A and B, placing the springs 27 in their respective places and with their respective backups 28 and 44, and making two sub-assemblies 21 and respectively pressing them into the core 11, but only to the extent to where the actuator 21 has space or room to still move more to the right to unlock the ball 19, as described. For cannulation the sleeves 21 each have an axial opening 51 therethrough, and there are the holes 43 and 46, as well as hole 41 which is useful in the T-handle construction because hole 41 aligns with the central opening 12.

While specific arrangements and method are disclosed herein, it should be understood that changes could be made without departing from the patentable concepts. The scope of the claimed matter should determine the extent of the patent right, and that scope should include equivalent handles and method of making them.

What is claimed is:

1. A method of making a tool which replaceably receives the shank of a driven tool, the steps comprising:

providing a handle with an opening having a longitudinal axis and a terminal open end, providing parts for a first sub-assembly of a sleeve, an actuator, and a ball and with said sleeve having a longitudinal axis and an interior opening extending along said sleeve axis and a radially disposed opening extending through said sleeve and into said interior opening, assembling said parts by placing said ball into said sleeve radial opening and placing said actuator onto said sleeve to be slidable thereon along said sleeve axis and having a surface on said actuator in contact with said ball for radially inward movement of said ball into said interior opening, for the driven tool locked mode, and said actuator arranged with a relief axially spaced from said surface on said actuator for radially outward movement of said ball, for the driven tool unlocked position, and inserting said sub-assembly into said handle opening through said open end and have said actuator against a spring in said handle opening and positioning said sleeve in said handle opening in a fixed position for movement of said actuator along said sleeve axis to thereby radially move said ball and to have said actuator in contact with said spring for urging said actuator in a direction toward said terminal end.

2. The method of making a tool, as claimed in claim 1, wherein:

said fixed positioning of said sleeve is aided by the application of knurling on the exterior of said sleeve and then pressing of said sleeve into said opening.

3. The method of making a tool, as claimed in claim 1, wherein:

forming said handle opening and said sleeve is in a cylindrical shape with an exterior circular surface on said sleeve, forming a groove on said sleeve surface and having said groove extend thereon in the longitudinal direction, and forming said actuator with a portion placeable in and extendable along said groove and free of extending beyond said exterior circular surface and with said portion including said actuator surface and said actuator relief.

4. The method of making a tool, as claimed in claim 1, including:

providing said handle with a second opening which extends transverse to said longitudinal axis, and inserting a second sub-assembly similar to said first sub-assembly into said handle second opening and against a second spring in said handle and having the sleeve of said second sub-assembly in a fixed position on said handle and having said actuator of said second sub-assembly against said second spring and being movable to control the ball of said second sub-assembly.

* * * * *